US006167707B1

(12) United States Patent
Price et al.

(10) Patent No.: US 6,167,707 B1
(45) Date of Patent: Jan. 2, 2001

(54) SINGLE-FLUID STIRLING/PULSE TUBE HYBRID EXPANDER

(75) Inventors: Kenneth D. Price, Long Beach; Carl S. Kirkconnell, Huntington Beach; Stephen C. Neville, El Segundo, all of CA (US)

(73) Assignee: Raytheon Company, Lexington, MA (US)

( * ) Notice: Under 35 U.S.C. 154(b), the term of this patent shall be extended for 0 days.

(21) Appl. No.: 09/292,028

(22) Filed: Apr. 16, 1999

(51) Int. Cl.[7] ..... F25B 9/00
(52) U.S. Cl. ..... 62/6; 60/520
(58) Field of Search ..... 62/6, 520

(56) References Cited

U.S. PATENT DOCUMENTS 4,711,650 * 12/1987 Faria et al. ..... 62/6
5,519,999 * 5/1996 Harpole et al. ..... 62/6
5,613,365 * 3/1997 Mastrup et al. ..... 62/6
5,647,219 * 7/1997 Rattray et al. ..... 62/6
5,920,133 * 7/1999 Penswick et al. ..... 62/6

* cited by examiner

*Primary Examiner*—Ronald Capossela
(74) *Attorney, Agent, or Firm*—Leonard A. Alkov; Colin M. Raufer; Glenn H. Lenzen, Jr.

(57) ABSTRACT

A hybrid two stage expander having a first stage Stirling expander coupled to a second stage pulse tube expander. Both stages are pneumatically driven by a common reciprocating compressor in a typical application. The first stage Stirling expander provides high thermodynamic efficiency which removes a majority of the heat load from gas within the cryocooler. The second stage pulse tube expander provides additional refrigeration capacity and improved power efficiency with little additional manufacturing complexity since it has no moving parts.

14 Claims, 3 Drawing Sheets

SINGLE-FLUID STIRLING/PULSE TUBE HYBRID EXPANDER

BACKGROUND

The present invention relates generally to cryocoolers, and more particularly, to a two stage cryocooler having a hybrid configuration employing a Stirling first stage expander and a pulse tube second stage expander.

Low temperature refrigeration needs can often be met more efficiently with multi-stage refrigerators than with traditional single stage devices. For applications requiring closed-cycle refrigeration where multiple stages have been deemed advantageous, previous designs have typically implemented two or more expander stages of the same type. Examples of these expanders include those of the Stirling, Gifford-McMahon, pulse tube, and Joule-Thomson designs.

It would therefore be an advantage to have an improved cryocooler that improves upon conventional single and multi-stage designs. Accordingly, it is an objective of the present invention to provide for a two stage cryocooler having a hybrid configuration that uses a Stirling first stage expander and a pulse tube second stage expander.

SUMMARY OF THE INVENTION

To meet the above and other objectives, the present invention provides for a two stage expander having a hybrid configuration that combines a first stage Stirling expander with a second stage pulse tube expander. Both stages are pneumatically driven by a common reciprocating compressor or motor. The two stage cryocooler is designed for long, highly reliable life and is sufficiently small and light weight to permit its use in spacecraft applications.

The use of the first stage Stirling expander provides high thermodynamic efficiency in that it removes a majority of the heat load from gas within the cryocooler. The use of the second stage pulse tube expander provides additional refrigeration capacity and improved power efficiency with little additional manufacturing complexity due to the simplicity of the pulse tube expander, which has no moving parts. One of the major refrigeration losses in a traditional single-stage pulse tube expander, regenerator pressure drop, is relatively small in the present hybrid two stage cryocooler since the pulse tube regenerator operates at a reduced temperature (higher density yields lower gas velocity, which results in a lower pressure drop).

The use of the second stage pulse tube expander enables the incorporation of a low-through heat exchanger at an interface between first and second stage expanders. This feature significantly improves first stage efficiency (relative to conventional single stage Stirling expanders) by virtue of the improved heat transfer coefficient at the thermal interface between the first and second stage expanders. Use of the first stage Stirling expander also reduces the total dead volume of the hybrid cryocooler compared to a pulse tube cooler (either one or two stage cooler having equivalent thermodynamic power). This reduces mass flow requirements, which in turn reduces the swept volume requirements of the compressor. This enables refrigeration to be accomplished with a smaller compressor.

The present invention may be adapted for use with cryogenic refrigerators used in military and commercial applications where the application demands high efficiency refrigeration at one or two temperatures, small size, low weight, long life, high reliability, and cost effective producibility. The primary intended use for the present invention is in space-based infrared sensors for civil and defense applications.

The present invention improves upon or displaces existing conventional cryocooler expanders including single and multi-stage Stirling expanders and single and multi-stage pulse tube expanders. The present hybrid expander achieves better performance at the same or lower manufacturing cost than either Stirling or pulse tube technology can deliver separately.

BRIEF DESCRIPTION OF THE DRAWINGS

The various features and advantages of the present invention may be more readily understood with reference to the following detailed description taken in conjunction with the accompanying drawing, wherein like reference numerals designate like structural elements, and in which.

DETAILED DESCRIPTION

Figure 1:
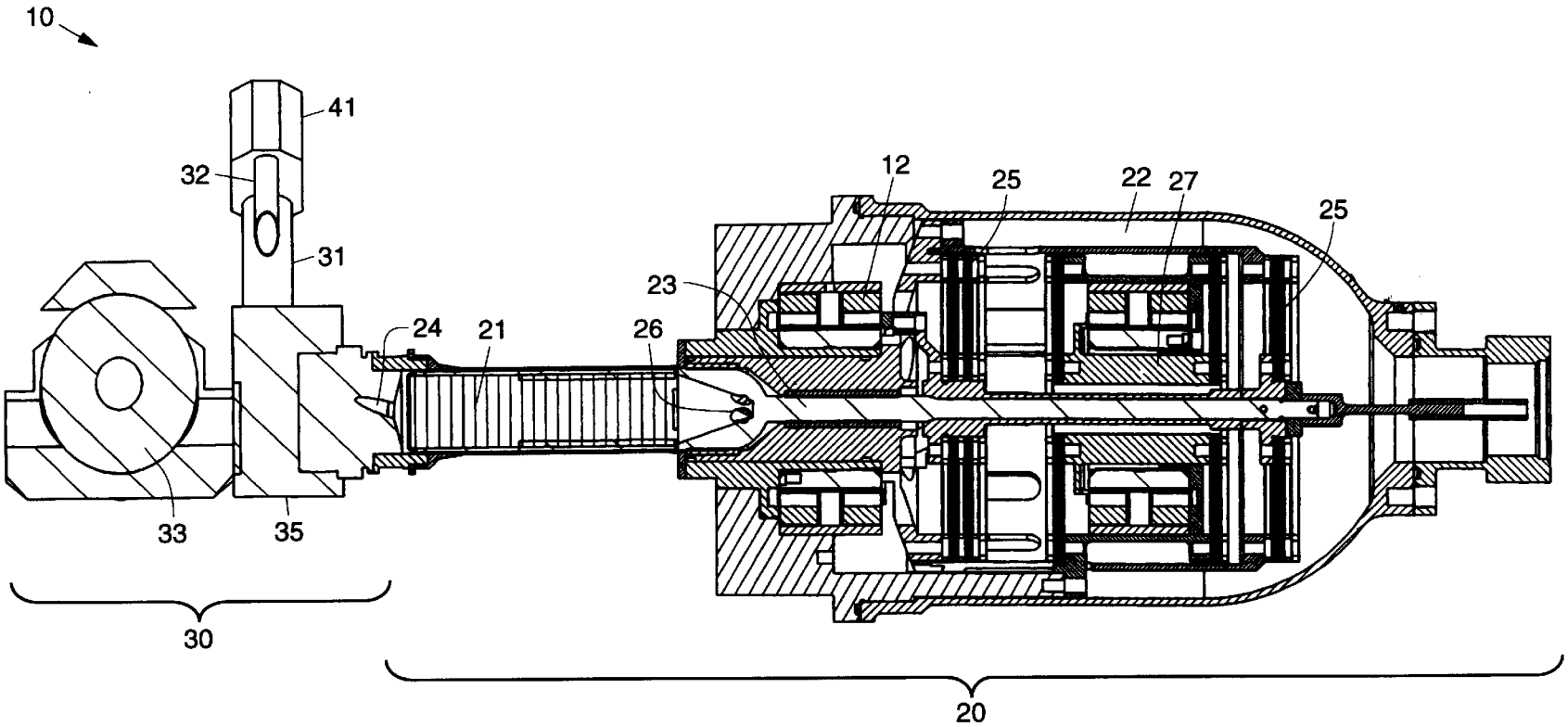
FIGS. 1–4 illustrate several cross sectional views of an exemplary hybrid two stage expander in accordance with the principles of the present invention.
Figure 2:
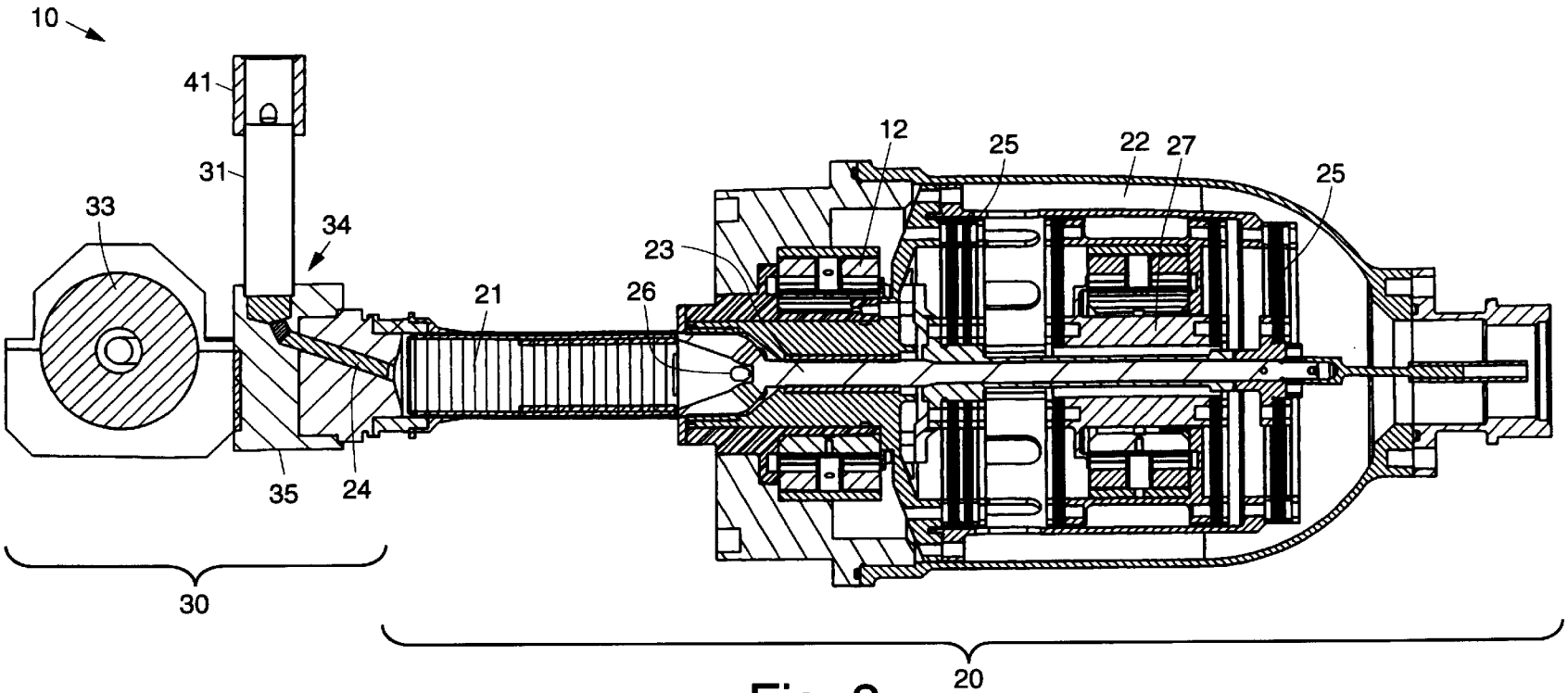
Figure 3:
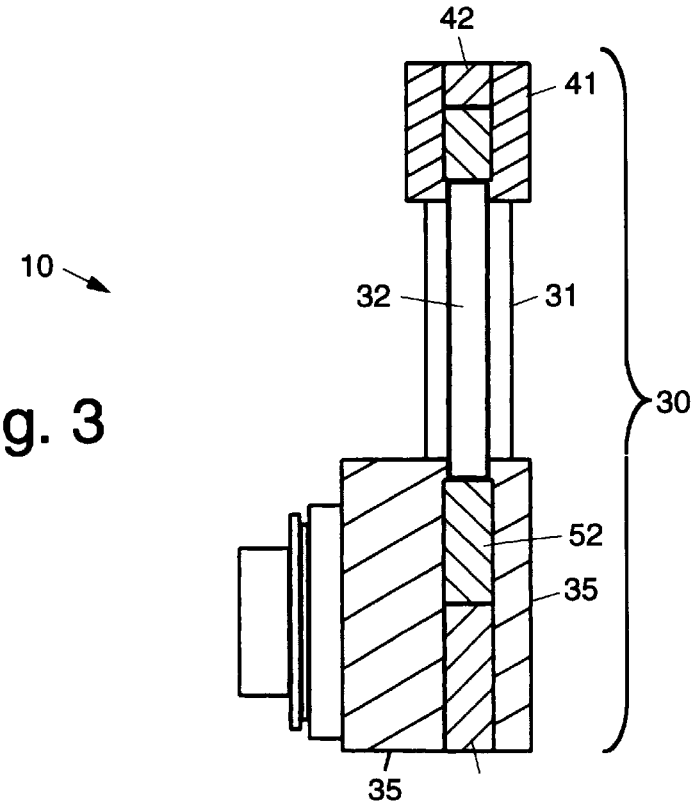
Figure 4:
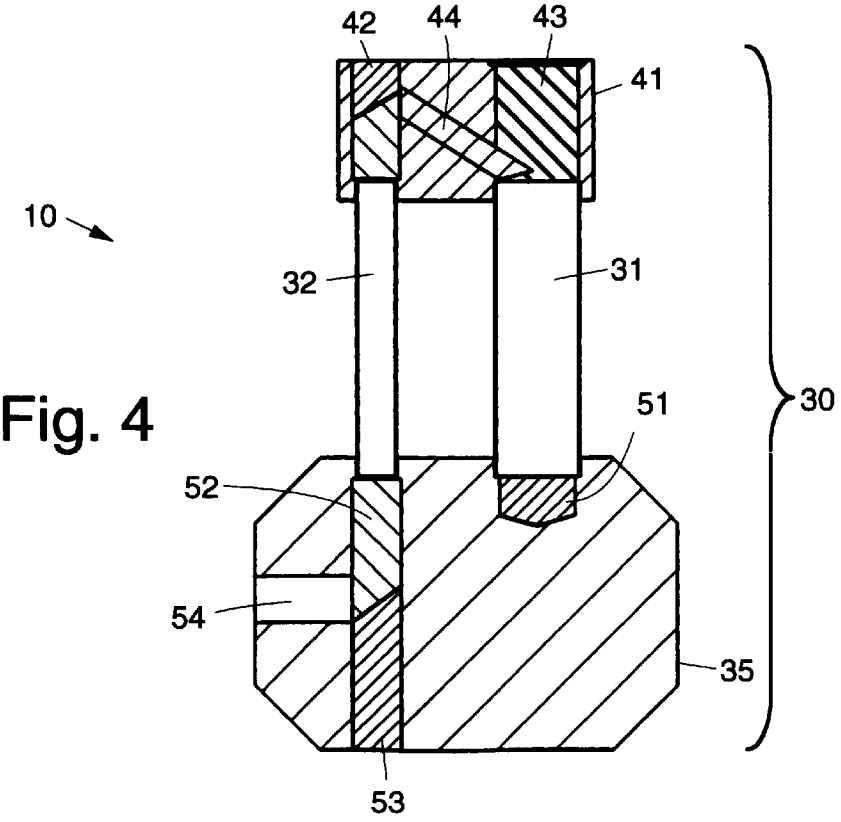

Referring to the drawing figures, FIGS. 1–4 illustrate cross sectional views of an exemplary hybrid two stage expander 10 in accordance with the principles of the present invention. The exemplary hybrid two stage expander 10 comprises first and second stages 20, 30. The first stage 20 comprises a Stirling expander 20 and the second stage 30 comprises a pulse tube expander 30.

The first stage Stirling expander 20 of the exemplary hybrid two stage cryocooler 10 comprises a flexure mounted Stirling expander 20. The Stirling expander 20 has a plenum 22 and a cold head comprising a thin walled cold cylinder, an expander inlet 26 disposed at a fore end of the plenum 22, a moveable displacer 23 or piston 23 disposed within the plenum 22, and a first stage regenerator 21 and heat exchanger 24.

The displacer 23 is suspended on fore and aft flexures 25. The displacer 23 is controlled and moved by means of a motor 12 located at a fore end of the plenum 22. A flexure suspended balancer 27 may be used to provide internal reaction against the inertia of the moving displacer 23.

The second stage pulse tube expander 30 comprises a second stage regenerator 31 or regenerative heat exchanger 31, a pulse tube 32, and a surge volume 33. The pulse tube 32 is coupled at one end to a second stage thermal interface 41. The second stage thermal interface 41 has a first end cap 42 that seals the pulse tube gas column 32, a second end cap 43 that seals the second stage regenerator 31 or regenerative heat exchanger 31. A second stage heat exchanger 44 is provided in the second stage thermal interface 41 that is coupled between the pulse tube 32 and the scond stage regenerator 31.

A flow-through heat exchanger 34 is disposed at a thermal interface 35 between first stage Stirling expander 20 and the second stage pulse tube expander 30. The flow-through heat exchanger 34 includes a pulse tube inlet heat exchanger 51 and a pulse tube outlet heat exchanger 52. A third end cap 53 seals the end of the pulse tube gas column 32 in the flow-through heat exchanger 34. A port 54 is disposed in the flow-through heat exchanger 34 that is coupled to the surge volume 33 and provides a phase angle control orifice.

In the hybrid two stage expander 10, a gas such as helium, for example, flows into the expander inlet 26 and into the first stage regenerator 21 and heat exchanger 24. Gas flowing into the cold volume within the first stage Stirling expander 20 is regenerated by the first stage regenerator 21 and heat exchanger 24. A portion of the gas remains in the first stage expansion volume of the first stage regenerator 21. Progressively smaller portions of the gas continue to the second stage regenerator 31, the pulse tube 32, and the surge volume 33. Gas return flow follows the same path in reverse.

A significant advantage of the hybrid two stage expander 10, compared with other multistage expanders, is the ease of shifting refrigerating power between the two stages 20, 30. This is accomplished by varying the stroke and/or phase angle of the displacer 23 in the Stirling first stage expander 20 and by means of the port 54, which alters mass flow distribution into the surge volume 33. This additional degree of control enables performance optimization at any operating point, including on orbit in the actual thermal environment of a spacecraft, for example. This feature provides for power savings when using the hybrid two stage expander 10.

The first stage Stirling expander 20 has high thermodynamic efficiency when removing the majority of the heat load from gas within the expander 10. The second stage pulse tube expander 30 provides additional refrigeration capacity and improved power efficiency. The second stage pulse tube expander 30 adds little additional manufacturing complexity because of its simplicity, in that it has no moving parts.

The flow-through heat exchanger 34 at the interface 35 between first and second stage expanders 20, 30 significantly improves first stage efficiency (relative to conventional single stage Stirling expanders) by virtue of the improved heat transfer coefficient at the thermal interface therebetween. The Stirling expander 20 reduces the total dead volume of the hybrid expander 10 compared to a conventional one or two stage pulse tube cooler having an equivalent thermodynamic power. The Stirling expander 20 thus reduces mass flow requirements, which reduces the swept volume of the compressor and enables refrigeration to be accomplished with a smaller compressor.

The regenerator pressure drop is relatively small in the hybrid two stage expander 10 because the pulse tube regenerator 31 operates at a reduced temperature. The gas thus has a higher density and produces a lower gas velocity, which results in a lower pressure drop.

The hybrid two stage expander 10 may be used in cryogenic refrigerators adapted for military and commercial applications where high efficiency refrigeration is required at one or two temperatures. The hybrid two stage expander 10 is also well suited for use in applications requiring small size, low weight, long life, high reliability, and cost effective producibility. The hybrid two stage expander 10 is particularly well suited for use in civil and defense space-based infrared sensors, such as those used in spacecraft infrared sensor systems, and the like.

Thus, an improved hybrid two stage expander has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A hybrid cryocooler comprising:

a first stage Stirling expander comprising an expansion volume having an expander inlet, a first stage regenerator, and an outlet, and a displacer which forces a working gas through the expander inlet and into the first stage regenerator of the expansion volume; and a second stage pulse tube expander thermally coupled to the first stage Stirling expander, the pulse tube expander comprising a pulse tube inlet in gaseous communication with the outlet of the expansion volume of the Stirling expander, and a pulse tube gas volume in gaseous communication with the pulse tube inlet, the gas volume including a second stage regenerator, a pulse tube gas column, and a surge tank.

2. The cryocooler recited in claim 1 wherein the displacer of the first stage Stirling expander is mounted on fore and aft flexures.

3. The cryocooler recited in claim 2 wherein the fore and aft flexures are separated by a rigid standoff.

4. The cryocooler recited in claim 1 wherein the second stage pulse tube expander comprises:

the second stage regenerator having the pulse tube inlet at a first end thereof;

the pulse tube gas column in gaseous communication with a second end of the second stage regenerator and thermally coupled to the second stage regenerator; and a surge volume coupled to the pulse tube gas column.

5. The cryocooler recited in claim 4 further comprising:

a second stage heat exchanger coupled between the pulse tube gas column and the second stage regenerator.

6. The cryocooler recited in claim 1 further comprising:

a flow-through heat exchanger disposed at a thermal interface between the first stage Stirling expander and the second stage pulse tube expander.

7. A hybrid two stage cryocooler comprising:

a first stage Stirling expander comprising an expansion volume having an expander inlet and an outlet, and a displacer which forces a working gas through the expander inlet and into the expansion volume;

a second stage pulse tube expander comprising a pulse tube inlet, a pulse tube gas volume in gaseous communication with the pulse tube inlet, the gas volume including a second stage regenerator, a pulse tube gas column, and a surge tank, and a second stage heat exchanger in thermal communication with the second stage regenerator and the pulse tube gas column;

a gas flow path establishing gaseous communication between the outlet of the expansion volume of the Stirling expander and the pulse tube inlet; and a flow-through heat exchanger disposed along the gas flow path between the output of the expansion volume of the Stirling expander and the pulse tube inlet.

8. The cryocooler recited in claim 7 wherein the displacer of the first stage Stirling expander is mounted on fore and aft flexures.

9. The cryocooler recited in claim 8 wherein the fore and aft flexures are separated by a rigid support.

10. The cryocooler recited in claim 7 wherein the first stage Stirling expander comprises:

a plenum with the expander inlet disposed at one end of the plenum and the displacer disposed within the plenum.

11. The cryocooler recited in claim 7 wherein the second stage pulse tube expander comprises:

the second stage regenerator having the pulse tube inlet at a first end thereof;

the pulse tube gas column in gaseous communication with a second end of the second stage regenerator and thermally coupled to the second stage regenerator; and a surge volume coupled to the pulse tube gas column.

12. A hybrid two stage cryocooler comprising:

a first stage Stirling expander having a Stirling expander outlet;

a second stage pulse tube expander having a pulse tube inlet;

a gas flow path extending between the Stirling expander outlet and the pulse tube inlet; and a heat exchanger in thermal contact with the gas flow path.

13. The cryocooler recited in claim 12 wherein the first stage Stirling expander comprises an expansion volume having an expander inlet and the Stirling expander outlet, and a displacer which forces a working gas through the expander inlet, into the expansion volume, and thence into the gas flow path.

14. The cryocooler recited in claim 12 wherein the pulse tube expander comprises a pulse tube inlet, a pulse tube gas volume in gaseous communication with the pulse tube inlet, the gas volume including a second stage regenerator, a pulse tube gas column, and a surge tank, and a second stage heat exchanger in thermal communication with the second stage regenerator and the pulse tube gas column.

* * * * *